United States Patent [19]

Sylvest

[11] 4,021,195

[45] May 3, 1977

[54] PLANETARY COOLER SYSTEM FOR ROTARY DRUMS SUCH AS KILNS

[75] Inventor: Karl Jens Sylvest, Copenhagen Valby, Denmark

[73] Assignee: F. L. Smidth & Co., Cresskill, N.J.

[22] Filed: Mar. 15, 1976

[21] Appl. No.: 666,915

[30] Foreign Application Priority Data

Mar. 18, 1975 United Kingdom ..... 11248/75

[52] U.S. Cl. ..... 432/80; 165/88

[51] Int. Cl.[2] ..... F27D 23/00; F27B 7/38

[58] Field of Search ..... 432/80, 78; 165/88

[56] References Cited

UNITED STATES PATENTS

| | | | |
|---|---|---|---|
| 2,001,258 | 5/1935 | Lindhard | 432/80 |
| 2,904,322 | 9/1959 | Bruff | 432/115 X |
| 3,502,139 | 3/1970 | Andersen | 432/80 |
| 3,643,933 | 2/1972 | McDonald | 432/80 |
| 3,830,623 | 8/1974 | Christiansen | 432/80 |
| 3,918,891 | 11/1975 | Theil | 432/80 |

*Primary Examiner*—John J. Camby
*Attorney, Agent, or Firm*—Pennie & Edmonds

[57] ABSTRACT

A planetary cooler system is disclosed for cooling hot pulverous or granular material produced and exited from the discharge end of an inclined rotary drum such as a rotary kiln. A plurality of cooler tubes are mounted in planetary fashion about the material discharge end of the kiln with the axis of each tube in parallel, or approximately parallel, relation to the axis of the drum. A conduit communicates the discharge portion of the rotary drum with each cooler tube for the passage of hot material therethrough in countercurrent to preheated cooling air passing from the cooler tube to the drum to serve as combustion air. The conduit is so positioned as to divide each cooler into at least two sections, a first section of the cooler tube extending away from the conduit in a direction generally upstream of the flow of material inside the kiln, and the second section extending away from the conduit in a direction generally downstream of the flow of material in the kiln. Both sections of each cooler tube have a material outlet end portion for discharging hot material such as cement clinker, and each outlet end portion has means associated therewith to permit the entrance of cooling air therein and to discharge hot material from the cooler tube section. The arrangement permits a greater capacity to handle relatively large volumes of material from the rotary kiln without altering the load to which the kiln sections are subjected. Also the necessity to increase the number of cooler tubes or diameters of the components involved is also avoided.

23 Claims, 4 Drawing Figures

FIG. 1
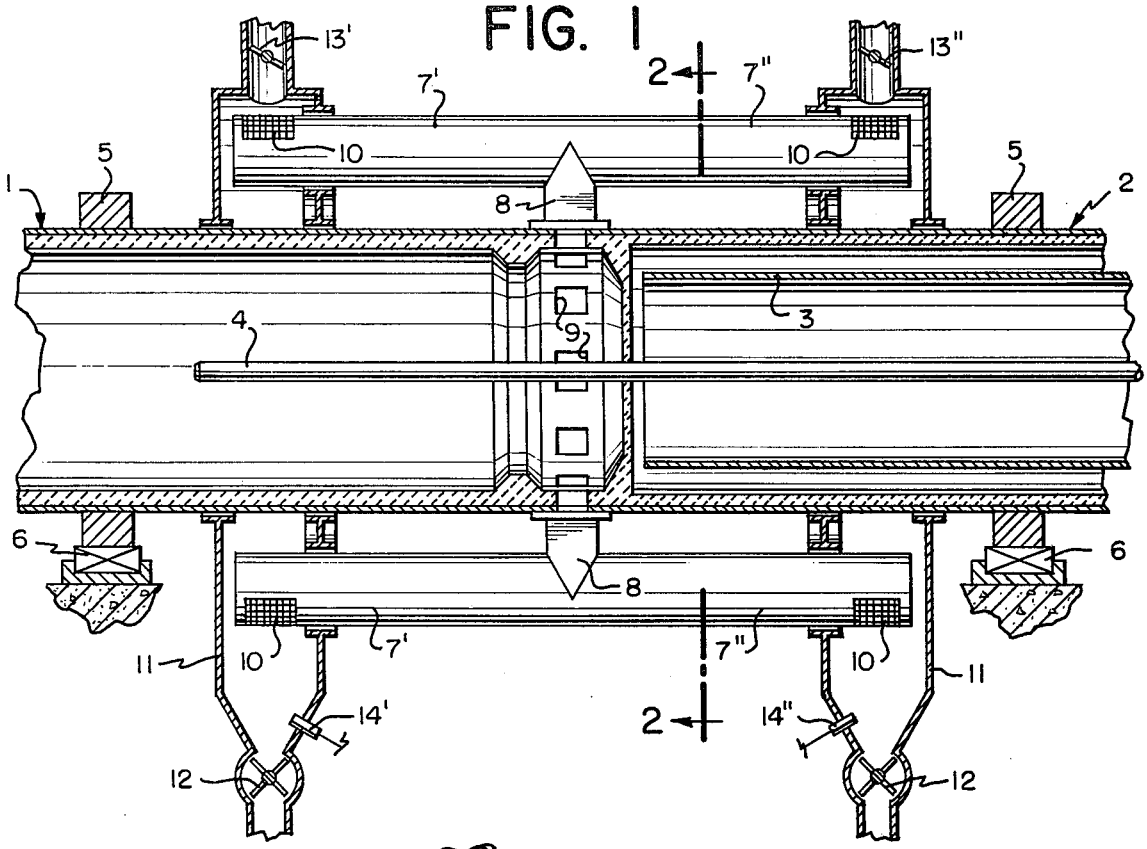
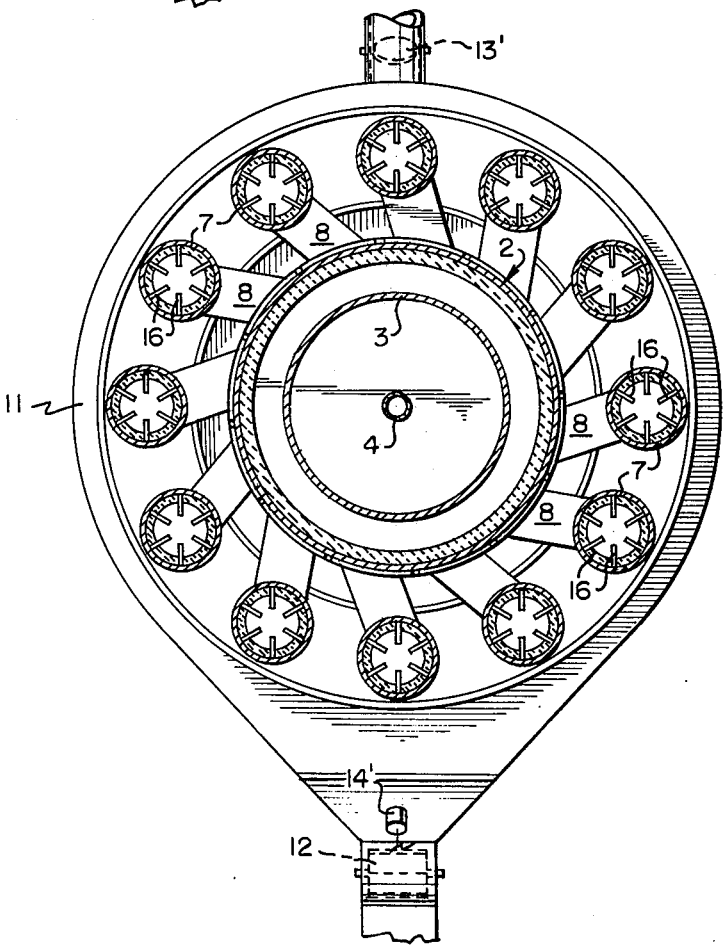
FIG. 2

PLANETARY COOLER SYSTEM FOR ROTARY DRUMS SUCH AS KILNS

BACKGROUND OF THE INVENTION

1. Field of the Invention

The invention relates to planetary cooler systems for rotary drums such as cement kilns.

2. Description of the Prior Art

In recent years rotary kilns have been designed for ever increasing outputs. The kilns are often constructed with a plurality of cooler tubes mounted in planetary fasion about their material outlet end. Owing to the increased output the planetary cooler tubes have had to be constructed in larger and larger units, with consequent increases in weight. The increase in weight subjects the kiln sections, at the points where the cooler tubes are attached, to very heavy mechanical loads.

Instead of using larger cooler tubes the number of tubes may be increased where large kiln plant diameters are involved, but the load to which the kiln sections are subjected is not altered appreciably. However, owing to the larger number of outlet openings in the kiln shell the risk of weakening the kiln sections always exists. If in order to obtain an improved cooling, more particularly of the inlet portions of the cooler tubes, the amount of cooling air is increased, this will cause an increasing amount of dust to be raised, with a consequent circulation of treated material between the kiln and cooler. I have invented a planetary cooler system for a rotary kiln which enables the kiln outlet to be increased while avoiding the risks of the prior art attempts.

SUMMARY OF THE INVENTION

A planetary cooler system for cooling hot material exiting from the discharge portion of an inclined rotary drum such as a rotary kiln. The system comprises a plurality of cooler tubes mounted in planetary fashion about the material discharge portion of the drum, with the axis of each cooler tube substantially parallel to the axis of the drum. A conduit communicates the discharge portion of the rotary drum with each cooler tube for the passage of hot material from the material discharge portion of the drum to each cooler tube. Each cooler tube is divided into at least two sections, a first section extending away from the conduit in a direction generally upstream of the flow of material inside the kiln, and the second section extending away from the conduit in a direction generally downstream of the flow of material in the kiln, and each cooler tube section has a material outlet end portion. The invention further comprises means associated with the material outlet end portion of each cooler tube section to permit the entrance of cooling air therein and to discharge hot material from each cooler tube section.

In the preferred embodiment each conduit is in the form of a chute extending from the cement clinker discharge end of a kiln to a position generally medial of the cooler tube so as to divide the cooler tube into the aforementioned uphill and downhill section.

The planetary cooler system according to the invention is thus particularly characterized in that each cooler tube is divided, where the chute enters the tube, into two parts, one of which extends upwardly and the other downwardly. This ensures that the flow of clinker having passed from the kiln through the chute will be divided into two equal or unequal flows. One of these flows will be caused to pass, under the influence of gravity, through the downwardly inclined part of the cooler tube, in countercurrent to a flow of cooling air. In this part of the cooling tube, the direction of conveyance of the clinker will thus be the same as that of the clinker inside the inclined kiln. The other flow of clinker is caused to pass, in a direction opposite to that of the first mentioned flow, through the upwardly inclined part of the cooler tube, likewise in countercurrent to a flow of cooling air. In order for this to be carried out the first part of each tube may be provided with generally helically configured conveyor flights to enable the material to be passed upwardly to the discharge openings.

Alternatively, the first part of each cooler tube may have a cross-sectional area which increases towards its free end. In other words, the first part of each cooler tube may for instance be frustoconical instead of the usual cylindrical shape. With this embodiment if the apex angle of the relevant cone is greater than twice the size of the angle of inclination of the kiln axis plus the angle needed to overcome friction, the conveyance of the material through that part of the cooler tube will take place by means of gravity and this will correspond to the material movement in the downwardly extending part of the cooler tube. Hence, for this embodiment it will be seen that the provision of conveyor flights or the like inside the upwardly extending part of the cooler tube will be superfluous. In addition, it is noted that the two parts of the cooler tube may be of equal or unequal length.

It is a substantial advantage of the invention that the air velocity in the cooler tubes may be reduced to about one-half of what is usual in known planetary coolers having the same output and tube diameter. Another advantage resides in the provision of supports for the cooler tubes on either side of the outlet openings of the kiln. The tubes are guided axially by the chutes between the kiln and cooler tubes, thus reducing the shear stresses produced by the load on the cooler tubes in the kiln section where the outlet openings are located.

Another advantage achieved by the invention is that the lowermost part of the rotary kiln may be reduced in length by approximately one-half of the length of the cooler tubes. As a result, the kiln will be provided with one support less than in the known construction, and this improvement results in a rather substantial economy.

In a preferred embodiment each cooler tube has a dividing wall, for dividing the flow of hot material from the drum into an upward and downward flow, the dividing wall being mounted in the cooler tube in front of the chute. The dividing wall may be formed and mounted so as to divide the flow of material into a given ratio which need not necessarily be one to one.

The dividing wall may extend into the chute, so as to divide it into two separate passages, one of these passages opening into the first section of the cooler tube and the other opening into the second section of the cooler tube. This arrangement enables each section of the tube to have its own connection to the kiln, and this connection is viewed as being particularly advantageous when larger cooler units are involved.

At least some of the cooler tubes or parts thereof may be provided with built-in lifting and conveying devices for cascading and conveying the material respectively.

As a result, an improved cooling effect from the cooling air supplied and an effective conveyance of the material are achieved.

The openings at the free ends of the upwardly extending section of the cooler tubes and the openings at the free ends of the downwardly extending section of the cooler tubes, may be surrounded by their own stationary casing equipped with means for supplying cooling air to the tubes and for collecting the cooled material.

The two casings surrounding the free ends of the cooler tubes may advantageously be equipped with means for controlling the amounts of cooling air supplied per time unit to the cooler tubes. This affords a possibility of regulating the discharge temperature of the cooled material, both for the upwardly extending and downwardly extending cooler portion, and, incidentally, independently of each other.

BRIEF DESCRIPTION OF THE DRAWINGS

Preferred embodiments of the invention are described hereinbelow with reference to the accompanying drawings wherein:

FIG. 1 is a view, partially in cross-section, of the lower portion of a rotary kiln having a planetary cooler system according to the invention;

FIG. 2 is a cross-section of the kiln and cooler system taken along line 2—2 of FIG. 1;

DETAILED DESCRIPTION OF THE PREFERRED EMBODIMENTS

Figure 3:
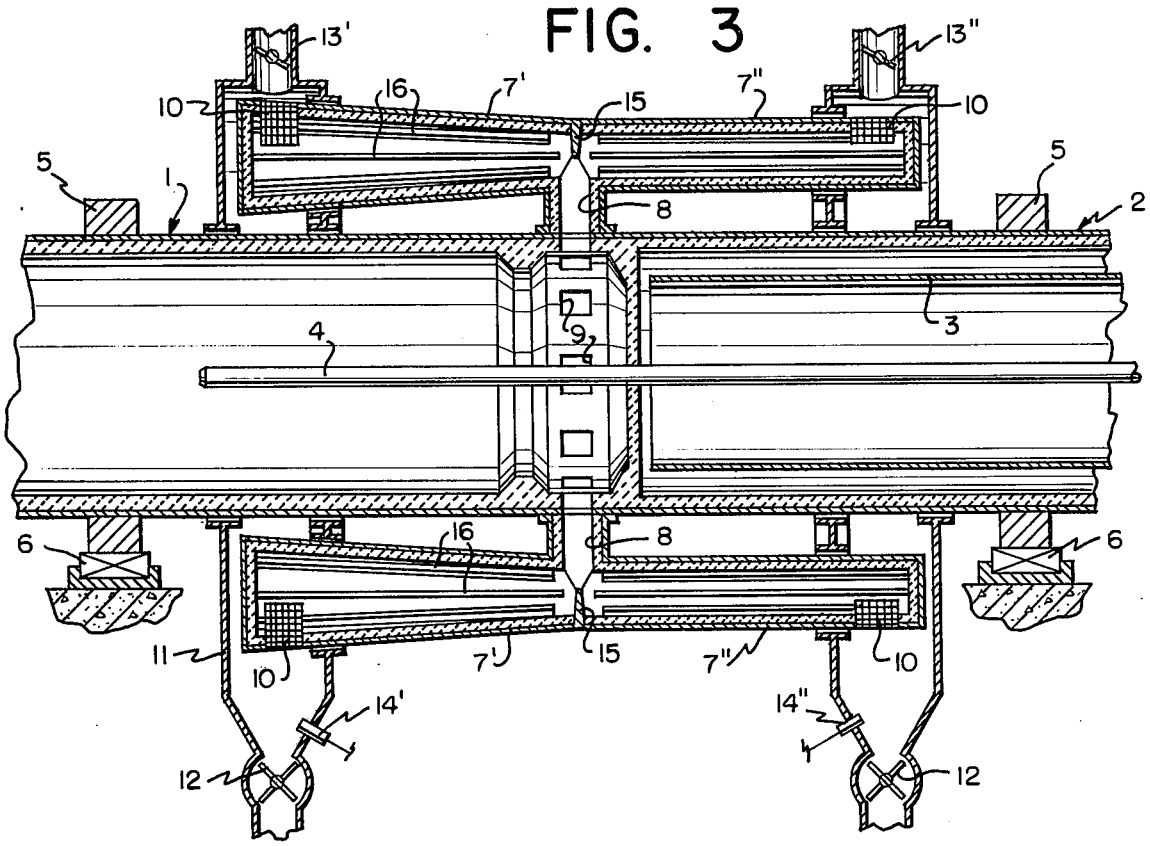
FIG. 3 is a view of a rotary kiln with a modified planetary cooler system having cylindrical/conical cooler tubes of a second embodiment.

Referring to FIGS. 1 and 2 there is shown the lower portion of a rotary kiln 1, the axis of which slopes downwardly from the left to right. A casing 2 rotates with the kiln and surrounds a stationary tunnel 3 and a burner pipe 4 used for firing the kiln. The kiln 1 has live rings 5 with corresponding supporting rollers 6, resting on foundations which are shown in part. The kiln 1 is provided with planetary upwardly and downwardly extending cooler tube parts 7′ and 7″ respectively, each connected with the kiln 1 by means of a chute 8, which receives the material to be cooled from the kiln through openings 9.

The cooler tubes 7′ and 7″ are provided at their outlet ends with outlet grates 10 through which the cooled material is passed out into stationary outlet casings 11. Each casing is provided with a discharge sluice 12. Control means 14′ and 14″ measure the clinker temperature and this temperature measurement is utilized to regulate cold-air flaps 13′ and 13″ in such a manner that the clinker temperature is kept constant even though the amount of clinker in 7′ and 7″ may vary. The cooling air is directed into the casings 11 and from there into each section of the cooler tubes 7′ and 7″ and then into the kiln as secondary combustion air.

FIG. 3 illustrates similarly, a rotary kiln and a planetary cooler system as described with reference to FIGS. 1 and 2. However, in FIG. 3 the cooler tubes each consist of a conical upwardly extending section 7′ and a cylindrical downwardly extending section 7″. The cooler tubes are provided with a dividing plate or cutter 15 facing the chute 8. Also each section of the cooler tubes is provided with lifters 16 as shown to improve the cooling effect on the material.

Figure 4:
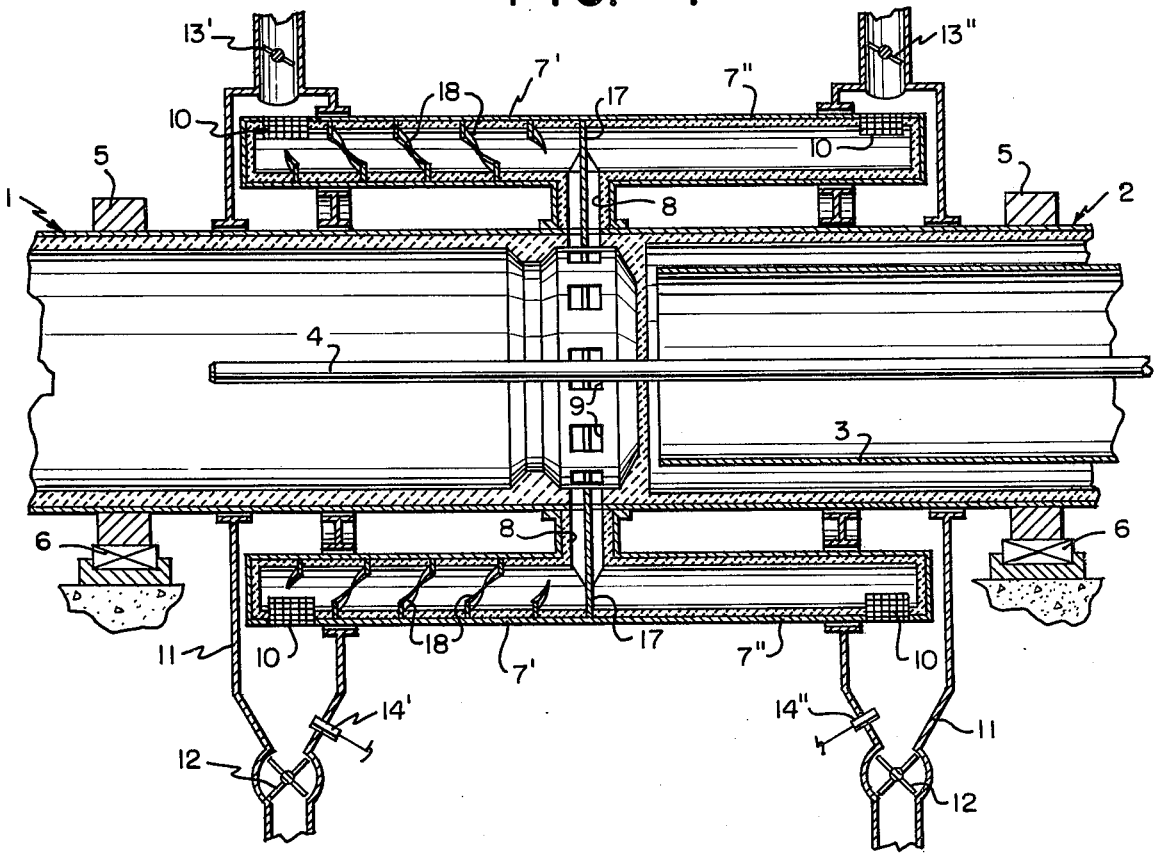
FIG. 4 is a vertical cross-sectional view through a kiln and cooler system illustrating a third embodiment of the invention.

FIG. 4 illustrates in cross-section, a rotary kiln with planetary cooler tubes which correspond to the tubes described with reference to FIGS. 1 and 2. However, the cooler tubes in this embodiment include generally helically configured conveying flights 18 provided in section 7′ of the tubes to provide assistance to the cement clinker in cooling and moving toward the discharge end of the uphill section of the cooler tube. In this embodiment it will be seen that lifters are not provided since the conveyor flights assist in cooling the material by providing the lifting action.

In the embodiment shown in FIG. 4 the chute 8 is provided with a dividing plate 17, dividing the chute into two sections so that the material from the kiln 1 is divided into two flows, one flow directed to the upwardly extending cooler tube section 7′, and another flow to the downwardly extending cooler tube section 7″.

The cooler system as described with reference to drawings operates as follows. The material produced in the rotary kiln 1 passes through the kiln to the outlet openings 9 at the lower end of the kiln. The hot material is fed through the chutes 8 to both the upwardly and downwardly extending planetary cooler tube sections 7′ and 7″.

In the chutes 8 the hot material is divided into two flows by means of a dividing cutter or dividing plate 15 or 17. The cooled material is discharged through outlet grates 10 into discharge casings 11 from which the material is carried away through the outlet sluices 12. The cooling air for the planetary cooler is fed to the outlet casing 11 through tubes equipped with regulating flaps 13′ and 13″. The flow of the cooling air is regulated according to the discharge temperature of the clinker as measured by pyrometers 14′ and 14″. The cooling air is passed into the cooler tubes countercurrent to the material through outlet grates 10. As can be seen, the cooling air is ultimately directed to the kiln through openings 9 and chutes 8 to be ultimately used in the kiln as preheated secondary combustion air.

I claim:

1. A planetary cooler system for cooling hot material exiting from the discharge portion of an inclined rotary drum such as a rotary kiln which comprises:

a. a plurality of cooler tubes mounted in planetary fashion about the material discharge portion of said drum with the axis of each cooler tube substantially parallel to the axis of the drum;

b. a conduit communicating the discharge portion of the rotary drum with each cooler tube for the passage of hot material therethrough, each cooler tube being divided into at least two sections, a first section extending away from said conduit in a direction generally upstream of the flow of material inside the kiln, the second section extending away from the conduit in a direction generally downstream of the flow of material in the kiln, and each cooler tube section having a material inlet end portion communicating with said conduit and a material outlet end portion; and c. means associated with the material outlet end portion of each cooler tube section to permit the entrance of cooling air therein and to discharge hot material from each cooler tube section.

2. The planetary cooler system according to claim 1 wherein each discharge conduit comprises a chute extending from the discharge end portion of said rotary drum to the material inlet portion of each cooler tube.

3. The planetary cooler tube according to claim 2 wherein each cooler tube includes a dividing wall mounted within the cooler tube approximately opposite said chute to divide into at least two streams, the flow of hot material received from the rotary drum, one stream flowing through the first cooler tube section, the second stream flowing through the other cooler tube section.

4. The planetary cooler system according to claim 3 wherein each material flow dividing wall extends into each associated chute so as to divide at least a portion of the chute into two separate passages, one passage opening into the first cooler tube section, and the second passage opening into the second cooler tube section.

5. The planetary cooler system according to claim 1 further comprising generally helically configured conveyor flights positioned within the first section of each cooler tube to enable material to be passed upwardly to the material outlet end portion of the cooler tube.

6. The planetary cooler system according to claim 4 further comprising generally helically configured conveyor flights positioned within the first section of each cooler tube to enable material to be passed upwardly to the material outlet end portion of the cooler tube.

7. The planetary cooler system according to claim 1 wherein the first section of each cooler tube has a cross-sectional area at the material outlet end portion greater than the cross-sectional area at the material inlet end portion.

8. The planetary cooler system according to claim 4 wherein the first section of each cooler tube has a cross-sectional area at the material outlet end portion greater than the cross-sectional area at the material inlet end portion.

9. The planetary cooler system according to claim 6 wherein the first section of each cooler tube has a cross-sectional area at the material outlet end portion greater than the cross-sectional area at the material inlet end portion.

10. The planetary cooler system according to claim 1 further comprising means for supplying cooling air to each cooler tube and for collecting cooled material therefrom positioned at the free end portions of the first and second sections of each cooler tube.

11. The planetary cooler system according to claim 2 further comprising means for supplying cooling air to each cooler tube and for collecting cooled material therefrom positioned at the free end portions of the first and second sections of each cooler tube.

12. The planetary cooler system according to claim 4 further comprising means for supplying cooling air to each cooler tube and for collecting cooled material therefrom positioned at the free end portions of the first and second sections of each cooler tube.

13. The planetary cooler system according to claim 5 further comprising means for supplying cooling air to each cooler tube and for collecting cooled material therefrom positioned at the free end portions of the first and second sections of each cooler tube.

14. The planetary cooler system according to claim 7 further comprising means for supplying cooling air to each cooler tube and for collecting cooled material therefrom positioned at the free end portions of the first and second sections of each cooler tube.

15. The planetary cooler system according to claim 1 further comprising means positioned at the free end portion of each section of each cooler tube for controlling the amount of cooling air supplied to the cooler tubes per unit time.

16. The planetary cooler system according to claim 2 further comprising means positioned at the free end portion of each section of each cooler tube for controlling the amount of cooling air supplied to the cooler tubes per unit time.

17. The planetary cooler system according to claim 3 further comprising means positioned at the free end portion of each section of each cooler tube for controlling the amount of cooling air supplied to the cooler tubes per unit time.

18. The planetary cooler system according to claim 4 further comprising means positioned at the free end portion of each section of each cooler tube for controlling the amount of cooling air supplied to the cooler tubes per unit time.

19. The planetary cooler system according to claim 5 further comprising means positioned at the free end portion of each section of each cooler tube for controlling the amount of cooling air supplied to the cooler tubes per unit time.

20. The planetary cooler system according to claim 10 further comprising means positioned at the free end portion of each section of each cooler tube for controlling the amount of cooling air supplied to the cooler tubes per unit time.

21. The planetary cooler system according to claim 1 further comprising material lifting means positioned within each cooler tube to lift material therein during rotation to thereby increase the cooling effect of cooling air passing therethrough.

22. The planetary cooler system according to claim 21 wherein said material lifting means comprises a plurality of elongated members secured longitudinally to inner wall portions of each cooler tube.

23. A planetary cooler for cooling hot material such as cement clinker exiting from the lower material discharge end portion of an inclined rotary kiln which comprises:

a. a plurality of cooler tubes mounted in planetary fashion about the lower end of the kiln, with the axis of each cooler tube substantially parallel to the axis of the kiln;

b. a chute communicating the discharge outlet end of the kiln with a generally medial portion of each cooler tube thereby dividing each cooler tube into two sections, a first uphill section extending away from said chute in a direction generally upstream of the flow of material in the kiln and terminating in a material outlet free end portion, and a second downhill section extending in a direction generally downstream of the flow of material in the kiln and terminating in a material outlet free end portion;

c. a casing positioned about the material oulet end portions of said uphill and downhill sections of said cooler tubes, said casing defining means to direct air into the material outlet free end portion of each cooler tube section while collecting cement clinker discharged from the outlet end portion of each cooler tube section;

d. means to measure the temperature of cement clinker discharged from the cooler tubes; and e. means to control cooling air directed to each cooler tube section in dependence upon the measured temperature of the cement clinker discharged therefrom.

* * * * *